United States Patent [19]

Shikata et al.

[11] 4,129,485

[45] Dec. 12, 1978

[54] METHOD FOR ELECTROLYTIC REMOVAL OF SCALE FROM BAND STEEL

[75] Inventors: Nobuo Shikata; Sukemitsu Ito, both of Tokyo, Japan

[73] Assignee: Agency of Industrial Science & Technology, Tokyo, Japan

[21] Appl. No.: 840,839

[22] Filed: Oct. 11, 1977

[30] Foreign Application Priority Data

Oct. 12, 1976 [JP] Japan ..... 51/122180

[51] Int. Cl.[2] ..... C25F 1/06; C25F 1/00

[52] U.S. Cl. ..... 204/144.5; 204/145 R

[58] Field of Search ..... 204/145 R, 144.5, 141.5, 204/129.43, 129.75, 129.8

[56] References Cited

U.S. PATENT DOCUMENTS

| | | | |
|---|---|---|---|
| 2,307,928 | 1/1943 | Hogaboom | 204/141.5 |
| 3,043,758 | 7/1962 | Machu | 204/145 R |
| 4,026,777 | 5/1977 | Zaremski | 204/145 R |

*Primary Examiner*—T. M. Tufariello

*Attorney, Agent, or Firm*—Kurt Kelman

[57] ABSTRACT

Removal of scale from scale-covered band steel is accomplished by subjecting the scale-covered band steel to electrolysis in an electrolyte of sodium chloride at temperatures of 80° to 100° C with the band steel used as the cathode and the electrode tool as the anode for thereby inducing a reaction of cathodic reduction which reduces ferrosoferric oxide ($Fe_3O_4$) as the main component of the scale into an amorphous substance and subsequently subjecting the treated band steel to electrolysis in an electrolyte of sodium chloride at the same tempertures with the band steel used as an anode and the electrode tool as a cathode for thereby inducing a reaction of anodic dissolution which causes the scale now in the form of amorphous substance to be dissolved out in the form of iron ion into the electrolyte.

3 Claims, 4 Drawing Figures

METHOD FOR ELECTROLYTIC REMOVAL OF SCALE FROM BAND STEEL

BACKGROUND OF THE INVENTION

This invention relates to a method for the removal of scale from band steel by virtue of electrolysis.

Generally band steel is produced by first hot rolling a strip of steel to approximate dimensions and subsequently cold rolling it to exact dimensions of the finished product desired. The hot rolling treatment results in the surface of the band steel being covered with scale. To ensure the dimensional accuracy of the finished product, therefore, it is prerequisite that preparatory to the cold rolling treatment, the band steel should be stripped completely of the scale.

For the purpose of such scale removal, there has heretofore been employed the practice of pickling by use of sulfuric acid or hydrochloric acid. This practice, however, has proved disadvantageous since the safe disposal of the spent acid from pickling is costly and the spent acid, if improperly disposed of, causes environmental pollution. Under the circumstances, development of a method for the removal of scale from band steel by virtue of electrolysis has been earnestly desired.

Heretofore, there has been suggested a method for the removal of scale from band steel by virtue of electrolysis (Japanese Pat. No. 313,084). This method aims to remove scale from the surface of stainless steel by subjecting the scale-covered stainless steel to an electrolytic reaction in the electrolyte of a salt solution of pH 7.0–1.0, and thereafter giving to the stainless steel a chemical aftertreatment in a dilute acid having a concentration of less than 30% at a temperature of not more than 80° C. Since the scale on the surface of stainless steel has a thickness of about 0.1$\mu$, it can easily be removed by this method. In the case of the scale formed on the surface of band steel, however, since it has a thickness of about 10$\mu$, it cannot be easily removed by this method.

By the electrolytic method described above, removal of scale from band steel can be attained to some extent by lengthening the duration of electrolysis. One possible measures for providing such a lengthened duration of electrolysis would be to greatly increase the dimensions of the electrolytic cell used and another would be to slow the speed of the motion of band steel through the electrolytic cell. Commercially, however, these measures prove infeasible.

An object of this invention is to provide a method for effective and economic removal of the scale of band steel by virtue of electrolysis. By the term "band steel" used herein is meant a hot rolled steel plate manufactured from a carbon steel having a carbon content of not more than 0.15% and a manganese content of not more than 0.6%.

SUMMARY OF THE INVENTION

To accomplish the object described above according to the present invention, there is provided a method for the removal of scale from band steel by virtue of electrolysis, which method comprises subjecting the band steel to electrolysis in an electrolyte formed preponderantly of sodium chloride at temperatures of 80° to 100° C. with the band steel used as the cathode and the electrode tool as the anode for thereby inducing a reaction of cathodic reduction and subsequently subjecting the treated band steel to electrolysis in a similar electrolyte at the same temperatures with the band steel used as the anode and the electrode tool as the cathode for thereby inducing a reaction of anodic dissolution.

When the band steel is subjected to said treatment of cathodic reduction, ferrosoferric oxide ($Fe_3O_4$) which is the principal component of the scale is reduced into an amorphous substance. When the band steel is subsequently subjected to the treatment of anodic dissolution, the scale which has been reduced to the amorphous substance is dissolved out in the form of iron ion into the electrolyte, with the result that the band steel is freed from the scale. The treatment of cathodic reduction produces the desired effect in less than 10 seconds if the electrolyte is kept at temperatures exceeding 80° C. Similarly in the treatment of anodic dissolution, the effect of the treatment increases with the increasing temperature of the electrolyte. In this case, the removal of scale from band steel can be attained more effectively and economically by utilizing the Joule's heat generated during the electrolysis for heating and keeping the electrolyte at desired temperatures.

The other objects and characteristics of the present invention will become apparent from the description of the invention to be given in further detail hereinafter with reference to the accompanying drawing.

DESCRIPTION OF THE PREFERRED EMBODIMENTS

Figure 1:
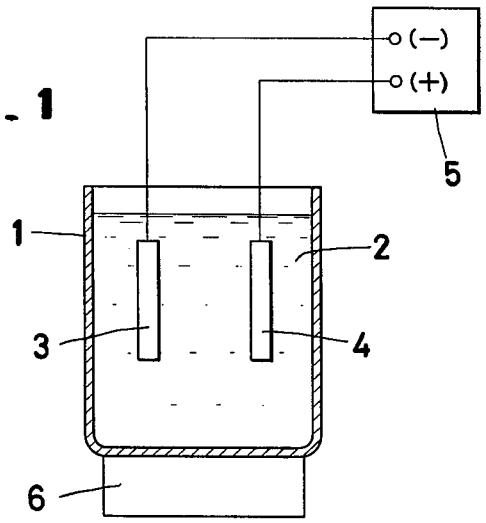
FIG. 1 is the structural diagram of an apparatus used for a test of the method of the present invention.

The inventors, with a view to providing advantageous removal of scale from band steel, studied a method resorting to an electrolytic reaction in a neutral electrolyte instead of the conventional method relying upon the technique of acid pickling. They have consequently made a discovery that the removal of scale by electrolysis can be accomplished more efficiently by subjecting the band steel first to a treatment of cathodic reduction and subsequently to a treatment of anodic dissolution than by subjecting the band steel solely to the treatment of anodic dissolution.

Thus, taking special notice of the fact that the treatment of cathodic reduction has a significant effect upon the scale removal, the inventors continued experiments and studies and, as a result, have acquired the knowledge that the scale layer, particularly the ferrosoferric oxide ($Fe_3O_4$) component thereof, is not dissolved at all by the treatment of anodic dissolution alone but it becomes readily removable by the treatment of anodic dissolution when the layer is reduced in advance into an amorphous substance by the treatment of cathodic reduction.

To elucidate this behavior of the scale layer, the inventors prepared test specimens made solely of ferrosoferric oxide by taking into account the fact that the main component of the scale on hot rolled steel plate is ferrosoferric oxide, and experimented on and investigated the behavior of ferrosoferric oxide in the reactions of reduction and dissolution in the aqueous sodium chloride solution. They have consequently established the following theory.

Ferrosoferric oxide is neither dissolved nor affected in any measure at all when it is subjected solely to the treatment of anodic dissolution. When it is subjected to the treatment of cathodic reduction, however, it is reduced into an amorphous substance in which the X-ray diffraction apparatus fails to identify the presence of any crystalline component. When the reduction product in the amorphous substance is subsequently subjected to the treatment of anodic dissolution, it is dissolved out in the form of iron ion into the electrolyte.

The reactions indicated above possibly proceed as shown below:

Anodic reaction:

$$2H_2O \rightarrow O_2 + 4H^+ + 4e^-$$

Cathodic reaction:

$$Fe_3O_4 + e^- \rightarrow \text{Amorphous substance}$$

$$2H_2O + 2e^- \rightarrow H_2 + OH^-$$

Anodic dissolution subsequent to cathodic reduction:

$$\text{Amorphous substance} \rightarrow Fe^{3+} + 3e^-$$

$$2H_2O \rightarrow O_2 + 4H^+ + 4e^-$$

The speed of the scale removal is notably increased when the anodic dissolution is effected subsequently to the cathodic reduction. Possibly the major reason therefor is that ferrosoferric oxide is converted by the cathodic reduction into an amorphous substance and, by the subsequent anodic dissolution, the amorphous substance is dissolved out in the form of iron ion into the electrolyte. Further, the hydrogen gas which is generated by the cathodic reduction also adds immensely to the efficiency of the scale removal because the hydrogen gas while in the process of bubbling up the electrolyte physically rubs and breaks up the scale adhering to the surface.

On the theory established as indicated above, the inventors took notice of the fact that the reduction of the ferrosoferric oxide component of the scale layer into the amorphous substance has an important effect upon the speed of scale removal and, while assuming a scale-removing line capable of treating the band steel at a practical rate of 200 m/min., made a study in search of a method capable of reducing the scale layer into the amorphous substance in the shortest possible time. They have, consequently, ascertained that when the cathodic reduction is performed in an electrolyte composed preponderantly of sodium chloride and elevated to high temperatures of 80° to 100° C., at least 50% of the scale layer can be reduced into the amorphous substance in a short time of from 3 to 5 seconds.

The present invention has issued from the foregoing knowledge. To be specific, the present invention accomplishes desired removal of scale from band steel by a method which comprises subjecting the scale-covered band steel to electrolysis in an electrolyte formed preponderantly of sodium chloride and kept at high temperatures of from 80° to 100° C. with the band steel used as a cathode and the electrode tool as an anode for thereby inducing a reaction of cathodic reduction which reduces ferrosoferric oxide as the main component of the scale into an amorphous substance and subsequently subjecting the treated band steel to electrolysis in a similar electrolyte at the same temperatures with the band steel used as an anode and the electrode tool as a cathode for thereby inducing a reaction of anodic dissolution which causes the scale in the form of said amorphous substance to be dissolved out in the form of iron ion into the electrolyte.

The reduction of the scale into the amorphous substance was tested by use of the apparatus shown in FIG. 1. With reference to FIG. 1, in an electrolytic cell 1 holding therein an aqueous solution containing 100 g/l of sodium chloride as the electrolyte 2, a test piece 3 and an electrode tool 4 were opposed each other at an interval of 60 mm and were respectively connected to the cathode and the anode of a D.C. source 5 as illustrated. Then the electrolytic cell 1 was placed on a heater 6, which was used to adjust the temperature of the electrolyte. A hot rolled steel plate 15 × 15 mm in area and 3.4 mm in thickness was used as the test piece 3 and a platinum plate 20 × 20 mm in area was used as the electrode tool 4 respectively. In this apparatus, a test was carried out by having the reduction voltage fixed at 10V, the temperature of the electrolyte varied from 20° to 100° C. and the duration of cathodic reduction varied from 2 to 60 seconds.

Figure 2:
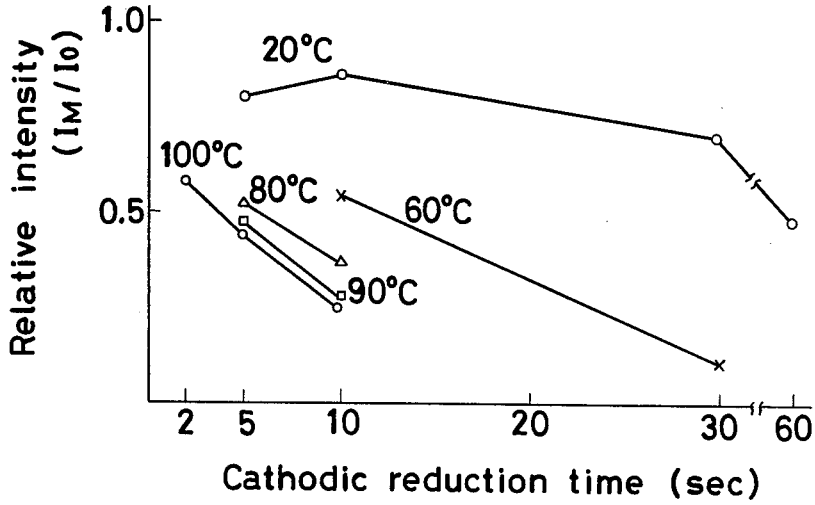
FIG. 2 is a graph showing the results of the test performed by use of the apparatus of FIG. 1.

The results of this test are shown in FIG. 2. The graph of FIG. 2 shows the relation between the duration of the treatment of cathodic reduction and the conversion of the crystalline component of scale into the amorphous substance for different electrolyte temperatures. The temperatures indicated in the graph represent those of the electrolyte used in the test. The conversion of the crystalline component of scale was determined by use of an X-ray diffraction device. The relative intensity, $I_M/I_O$, graduated along the vertical axis of the graph represents the ratio of the intensity ($I_O$) of the crystalline component of ferrosoferric oxide after the cathodic reduction to that ($I_O$) before the cathodic reduction, as determined in terms of the height of peak of ferrosoferric oxide, the main component of the scale composition, at $2\theta = 53.8°$. Unity, $I_M/I_O = 1$, is when the cathodic reduction has absolutely no effect. The relative intensity $I_M/I_O$ in this instance has a meaning such that the ratio of the conversion of ferrosoferric oxide into the amorphous substance increases with the decreasing value of $I_M/I_O$ from the unity 1.

From FIG. 2 it is seen that at the electrolyte temperature of 20° C., cathodic reduction treatment for 30 seconds reduces only about 30% of the scale layer into the amorphous substance, and at the electrolyte temperature of 100° C., the treatment given for 2 seconds and 5 seconds reduces 42% and 56% respectively of the scale layer into the amorphous substance. That is to say, the effect of the treatment of cathodic reduction is manifested with added conspicuousness when the electrolyte temperature exceeds the level of 80° C.

When the band steel is subjected to the treatment of cathodic reduction in an electrolyte whose temperature exceeds the level of 80° C., as described above, the scale is reduced into an amorphous substance. The scale now in the form of an amorphous substance is dissolved out in the form of iron ion into the electrolyte by further subjecting the treated band steel to the treatment of anodic dissolution wherein the band steel and the electrode are connected to the anode and the cathode respectively.

According to this invention, the temperature of the electrolyte is desired to exceed 80° C. in both treatments and 3 to 10 seconds and 15 to 25 seconds suffice respectively for the treatments of cathodic reduction and anodic dissolution.

For either of the treatments, the electrode tool to be used is made of the same material as that of the band steel subjected to the treatments. As the electrolyte, there is used an aqueous solution of sodium chloride. Since the concentration of sodium chloride in this aqueous solution has no appreciable effect upon the removal of the scale, it is desired to fall in the range of from 20 to 30% with due consideration for the electric conductivity. The electrolytic conditions for cathodic reduction and anodic dissolution are from 3 to 10V of feed voltage and 0.5 to 1.0 A/cm$^2$ of current density.

Figure 3:
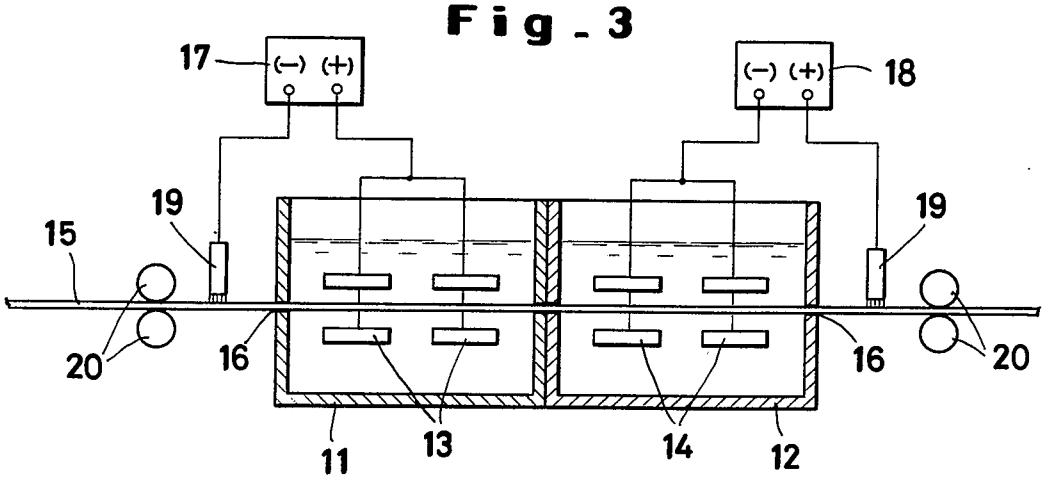
FIG. 3 is a sectioned view illustrating one embodiment of the device employed for practicing the method for removal of scale from band steel in accordance with the present invention.

FIG. 3 shows one embodiment of the apparatus to be used for practicing the method of this invention for the removal of scale of band steel. With reference to FIG. 3, a pair of unit electrolytic cells 11, 12 having an identical construction are disposed consecutively. In each unit electrolytic cell, an electrolytic cell filled with electrolyte is provided with slits 16 through which a band steel 15 is conveyed for contact with the electrolyte.

In the first electrolytic cell 11, electrodes 13 are opposed to the band steel 15 and these electrodes 13 are connected to the plus terminal of the first power source 17. The band steel 15 in motion into the first electrolytic cell 11 is connected via a feeding brush 19 to the minus terminal of the first power source 17. The electrodes 14 opposed to the band steel inside the second electrolytic cell 12 are connected to the minus terminal of the second power source 18. The band steel 15 being discharged from the second electrolytic cell 12 is connected via a feeding brush 19 to the plus terminal of the second power source 18.

When an electric current is sent to the electrode and the band steel in the electrolytic cell having the above-mentioned structure, Joule's heat is generated and the electrolyte between the electrode and the band steel is heated by the generated Joule's heat. When the electrolyte is heated to a temperature exceeding 80° C., the feed rollers 20 are rotated to successively convey the band steel. As a consequence, in the first electrolytic cell 11 a reaction of cathodic reduction reduces ferrosoferric oxide which is the principal component of the scale into an amorphous substance and a reaction of anodic dissolution causes the scale now in the form of amorphous substance to be dissolved out in the form of iron ion into the electrolyte in the second electrolytic cell 12, and thereby the scale is removed from the band steel. Since the electrolyte is constantly heated by Joule's heat, the electrolysis is carried out in a state wherein the electrolyte is boiled.

As described above, the present invention carries out the removal of scale from band steel by keeping the electrolyte in its boiling state. When the aqueous solution of sodium chloride is used as the electrolyte, there is no possibility of the boiling electrolyte affecting the material of which the electrolytic cell is made. Use of the boiling electrolyte, therefore, serves to provide effective removal of scale and, at the same time, permit full utilization of thermal energy.

In an actual operation in which the band steel is conveyed at the rate of 200 m/min and is subjected to the treatment of cathodic reduction for about 6 seconds and to that of anodic dissolution for about 15 seconds, for example, the electrolytic cell for the treatment of cathodic reduction is required to have a length of about 20 m and that for the treatment of anodic dissolution a length of about 50 m respectively. In the meantime, to the surface of the band steel, an electric current must be supplied at a density of 0.5 to 1.0 A/cm$^2$. As the dimensions of the electrolytic cells grow larger as described above, the surface area of the band steel will be proportionally increased and the total electric current required for the treatments will be increased to an enormous amount. Even if the specific resistance of the band steel is small, the electric potential in the band steel may be lowered to the extent of preventing the scale removal from being effectively accomplished where the supply of electric current is made by an improper method.

Figure 4:
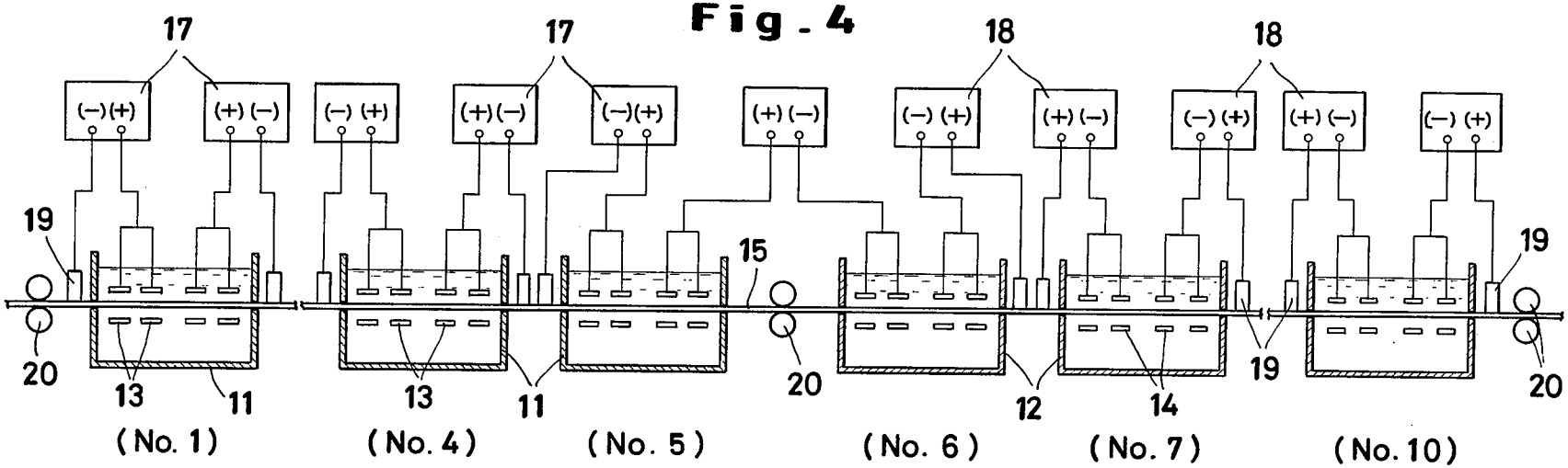
FIG. 4 is a schematic diagram illustrating another embodiment of the device employed for practicing the method of this invention.

To preclude this possible trouble, a total of five electrolytic cells each 4 meters in length are disposed and operated as illustrated in FIG. 4 for the treatment of cathodic reduction and a total of 13 electrolytic cells each 4 meters in length are disposed and operated for the treatment of anodic dissolution. The individual electrolytic cells have the same constructions as those shown in FIG. 3. The electrodes 13 used in the electrolytic cells 11 (No. 1 through No. 5) for the treatment of cathodic reduction are connected to the plus terminal of the power source 17 and the band steel 15 is connected to the minus terminal of the power source. Then, the electrodes 14 used in the electrolytic cells 12 (No. 6 through No. 18) for the treatment of anodic dissolution are connected to the minus terminal of the power source 18 and the band steel is connected to the plus terminal of the power source.

When the flow of direct current is passed to the groups of electrodes and the band steel in the electrolytic cells as illustrated in FIG. 4, the electrolytic cells No. 1 through No. 5 serve as those for the treatment of cathodic reduction and the electrolytic cells No. 6 through No. 18 serve as those for the treatment of anodic dissolution respectively. Thus, the removal of scale from the band steel by electrolysis can be carried out, with the possible drop of the electric potential in the band steel reduced to a great extent.

When, in these electrolytic cells each 4 meters in length, a band of ordinary steel 2 meters in width and 3.5 mm in thickness is treated with the maximum current density fixed at 0.5 A/cm$^2$, then each D.C. power source is required to have a current capacity of 24000 A. Since the specific resistance in ordinary steel is about 10 $\mu$.ohm.cm, the potential drop in the band steel is about 0.5 V, a value negligibly small as compared with the voltage, 10 V, between the band steel and the groups of electrodes.

When the removal of scale from band steel is effected by subjecting the scale-covered band steel first to the treatment of cathodic reduction and subsequently to the treatment of anodic dissolution in compliance with the method of this invention, the electrolyte which is used in the treatments is kept at an elevated temperature or in a boiling state by virtue of the Joule's heat generated because of the electrolysis. Owing to the use of such a hot or boiling electrolyte, the efficiency of the scale removal is greatly heightened and any excess thermal energy can be utilized as the heat for vaporization of water. In addition, because of the advantageous exploitation of Joule's heat, the electrolytic line used in the operation can dispense with a device otherwise required for the purpose of regulating thermal energy. The desired removal of scale from the band steel, accordingly, can be accomplished effectively and economically by the method of this invention.

What is claimed is:

1. A method for the removal of scale composed preponderantly of $Fe_3O_4$ and having a thickness of about 10μ from band steel consisting of a hot rolled steel plate of carbon steel, consisting of the steps of subjecting the band steel to electrolysis for a period of from 3 to 10 seconds in an electrolyte composed of an aqueous solution of sodium chloride at temperatures in the range of from 80° to 100° C., the electrolysis being effected with feed voltages in the range of from 3 to 10 V and current densities in the range of from 0.5 to 1.0 A/cm$^2$, with the band steel used as a cathode and an electrode tool as an anode, and then subjecting the band steel to electrolysis for a period of from 15 to 25 seconds in the aqueous solution of sodium chloride at temperatures of from 80° to 100° C., with feed voltages of from 3 to 10V and current densities of from 0.5 to 1.0 A/cm$^2$, with the treated band steel used as the anode and the electrode tool as the cathode.

2. The method according to claim 1, wherein the electrolyte is heated to and maintained at the temperature by use of Joule's heat which is generated by the electrolysis.

3. The method according to claim 1, wherein the concentration of sodium chloride in said aqueous solution falls in the range of from about 20 to about 30%.

* * * * *